US011334008B2

(12) United States Patent
Shimodaira

(10) Patent No.: US 11,334,008 B2
(45) **Date of Patent: *May 17, 2022**

(54) SHEET-MEMBER GUIDE STRUCTURE AND IMAGE FORMING APPARATUS

(71) Applicant: FUJIFILM Business Innovation Corp., Tokyo (JP)

(72) Inventor: Akira Shimodaira, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/037,565

(22) Filed: Sep. 29, 2020

(65) Prior Publication Data

US 2021/0011399 A1 Jan. 14, 2021

Related U.S. Application Data

(63) Continuation-in-part of application No. 16/255,843, filed on Jan. 24, 2019, now Pat. No. 11,048,200.

(30) Foreign Application Priority Data

Jul. 23, 2018 (JP) ..... JP2018-137962

(51) Int. Cl.
*G03G 15/00* (2006.01)
*G03G 15/20* (2006.01)

(52) U.S. Cl.
CPC ..... *G03G 15/2028* (2013.01); *G03G 15/6529* (2013.01)

(58) Field of Classification Search
CPC ..... G03G 15/6529
USPC ..... 399/400
See application file for complete search history.

(56) References Cited

U.S. PATENT DOCUMENTS 7,532,853 B2 * 5/2009 Shimizu ..... G03G 15/657 399/397
10,509,345 B1 * 12/2019 Ichiki ..... G03G 15/6576
2005/0201795 A1 * 9/2005 Kawachi ..... B65H 29/52 399/406
2007/0147920 A1 * 6/2007 Shimizu ..... G03G 15/657 399/400
2010/0310262 A1 * 12/2010 Nanayama ..... G03G 15/234 399/23
2016/0252865 A1 * 9/2016 Shimodaira ..... G03G 15/2028 399/400

* cited by examiner

*Primary Examiner* — Anthony H Nguyen
(74) *Attorney, Agent, or Firm* — JCIPRNET

(57) ABSTRACT

A sheet-member guide structure includes a first guide member that guides a sheet member from a fixing unit to a transport roller unit, the fixing unit fixing an image formed on the sheet member to the sheet member by heating the sheet member that is transported, the transport roller unit transporting the sheet member; and a second guide member that comes into contact with the sheet member to which the image has been fixed by the fixing unit and guides the sheet member to the transport roller unit, the second guide member being disposed downstream of the first guide member in a transporting direction in which the sheet member is transported and being made of a material having a thermal conductivity higher than a thermal conductivity of a material of the first guide member.

14 Claims, 12 Drawing Sheets

SHEET-MEMBER GUIDE STRUCTURE AND IMAGE FORMING APPARATUS

CROSS-REFERENCE TO RELATED APPLICATIONS

This application is a continuation-in-part application of and claims priority benefit of U.S. application Ser. No. 16/255,843, filed on Jan. 14, 2019, which claims priority under 35 USC 119 from Japanese Patent Application No. 2018-137962 filed Jul. 23, 2018. The entirety of each of the above-mentioned patent applications is hereby incorporated by reference herein and made a part of this specification.

BACKGROUND

(i) Technical Field

The present disclosure relates to a sheet-member guide structure and an image forming apparatus.

(ii) Related Art

Japanese Unexamined Patent Application Publication No. 2006-003404 describes an image forming apparatus including a fixing unit and a negative-pressure transport belt. The fixing unit fixes a toner image formed on a paper sheet to the paper sheet by heating the toner image. The negative-pressure transport belt, which is disposed downstream of the fixing unit along a sheet transport path, transports the paper sheet further downstream while the toner image that has been heated and fixed by the fixing unit does not come into contact with a certain member.

SUMMARY

For example, a guide member for guiding the recording medium from the fixing unit to a transport roller unit, which discharges the recording medium to the outside of the apparatus, is provided between the fixing unit and the transport roller unit. According to the related art, the guide member is made of a resin material, and guides the recording medium to the transport roller unit by coming into contact with the recording medium to which an image has been fixed by the fixing unit.

The recording medium is heated to a high temperature in the region where the image has been fixed thereto by the fixing unit. When the recording medium comes into contact with the transport roller unit while the temperature thereof is high, contact marks, or "roller marks", are formed on the image on the recording medium due to contact with the transport roller unit.

Aspects of non-limiting embodiments of the present disclosure relate to a technology for making the occurrence of contact marks on an image formed on a sheet member due to contact with a transport roller unit less than that in the case where guide members that guide the sheet member from a fixing unit to the transport roller unit are made of materials having similar thermal conductivities over the entirety thereof.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a sheet-member guide structure including a first guide member that guides a sheet member from a fixing unit to a transport roller unit, the fixing unit fixing an image formed on the sheet member to the sheet member by heating the sheet member that is transported, the transport roller unit transporting the sheet member; and a second guide member that comes into contact with the sheet member to which the image has been fixed by the fixing unit and guides the sheet member to the transport roller unit, the second guide member being disposed downstream of the first guide member in a transporting direction in which the sheet member is transported and being made of a material having a thermal conductivity higher than a thermal conductivity of a material of the first guide member.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
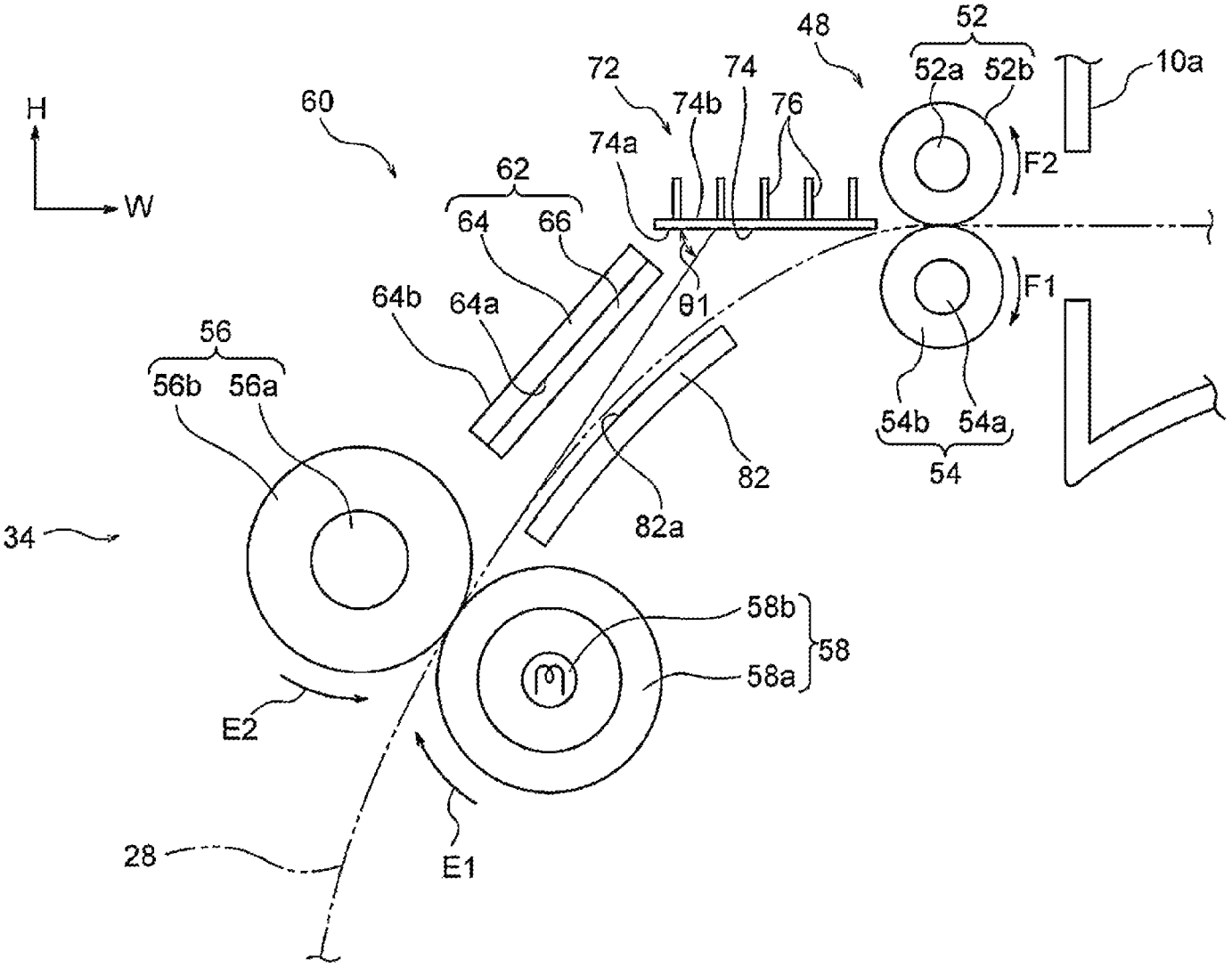
FIG. 1 is a side view of a guide structure according to a first exemplary embodiment of the present disclosure.

An example of a sheet-member guide structure and an image forming apparatus according to a first exemplary embodiment of the present disclosure will be described with reference to FIGS. 1 to 10. In the drawings, arrow H indicates an apparatus up-down direction (vertical direction), arrow W an apparatus width direction (horizontal direction), and arrow D an apparatus depth direction (horizontal direction).

Image Forming Apparatus 10

Figure 10:
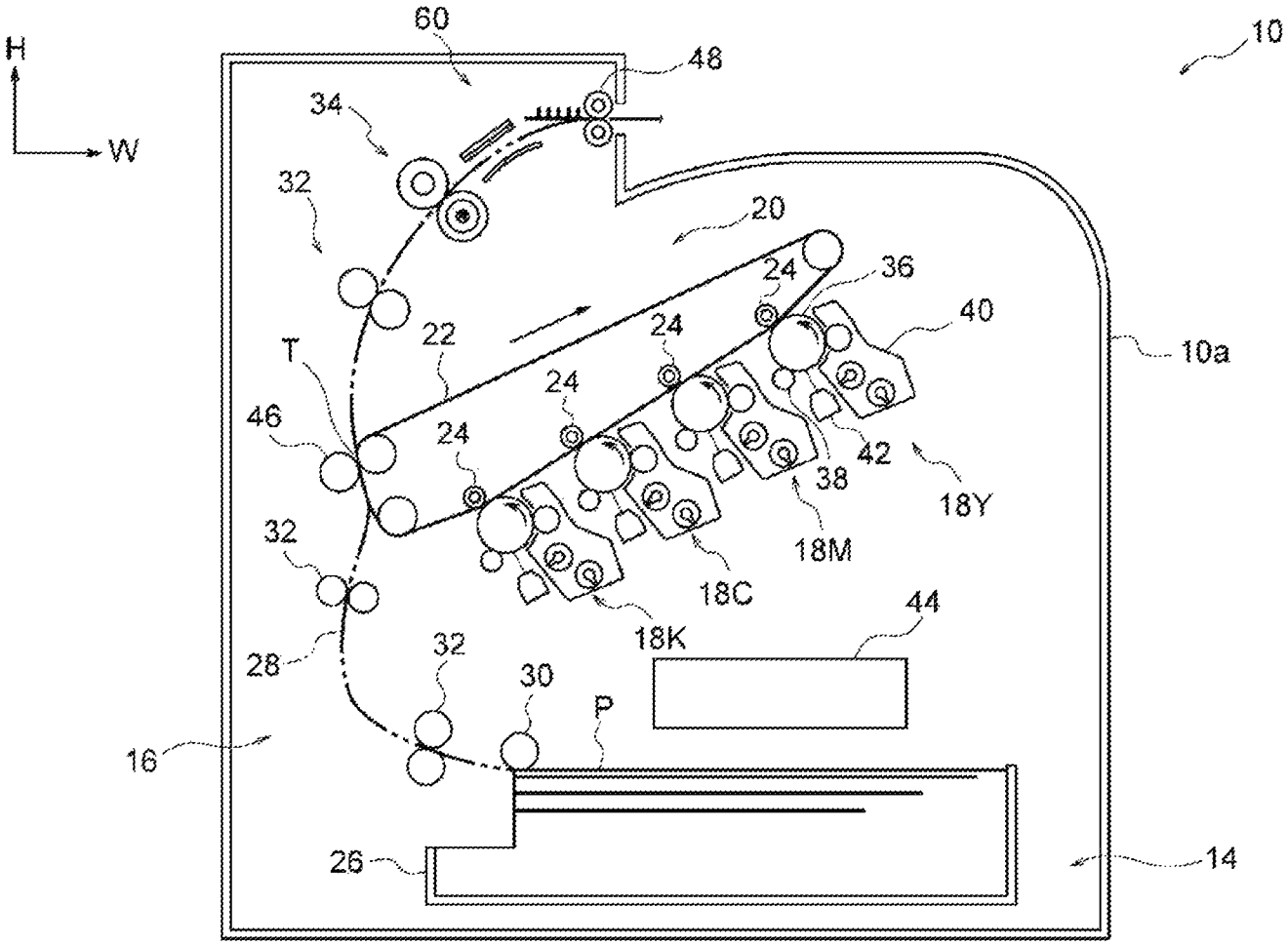
FIG. 10 illustrates the image forming apparatus according to the first exemplary embodiment of the present disclosure.

As illustrated in FIG. 10, an image forming apparatus 10 includes a storage unit 14, a transport unit 16, and an image forming section 20, which are arranged in that order from the bottom toward the top in the up-down direction. The storage unit 14 stores sheet members P. The transport unit 16 transports the sheet members P stored in the storage unit 14. The image forming section 20 forms images on the sheet members P transported from the storage unit 14 by the transport unit 16. The image forming apparatus 10 also includes a controller 44 that controls each unit. The sheet members P are, for example, recording media such as sheets of paper or films.

Storage Unit

The storage unit 14 includes a storage member 26 that may be pulled forward from an apparatus body 10*a* of the image forming apparatus 10 in the apparatus depth direction. The sheet members P are stacked on the storage member 26. The storage unit 14 also includes a feed roller 30 that feeds the top sheet member P of the stack on the storage member 26 to a transport path 28, which is included in the transport unit 16.

Transport Unit

The transport unit 16 includes plural transport roller units 32 that transport the sheet member P along the transport path 28, and a discharge roller unit 48 that discharges the sheet member P to the outside of the apparatus body 10*a* along the transport path 28 after a toner image is formed on the sheet member P. The discharge roller unit 48 is an example of a transport roller unit.

The transport unit 16 also includes a guide structure 60 that guides the sheet member P to which the toner image has been fixed by a fixing unit 34, which will be described below, toward the discharge roller unit 48. The discharge roller unit 48 and the guide structure 60 will be described in detail below.

Image Forming Section

The image forming section 20 includes four image forming units 18Y, 18M, 18C, and 18K, which are yellow (Y), magenta (M), cyan (C), and black (K) image forming units, respectively. In the following description, the characters Y, M, C, and K may be omitted when it is not necessary to distinguish between Y, M, C, and K.

Figure 9:
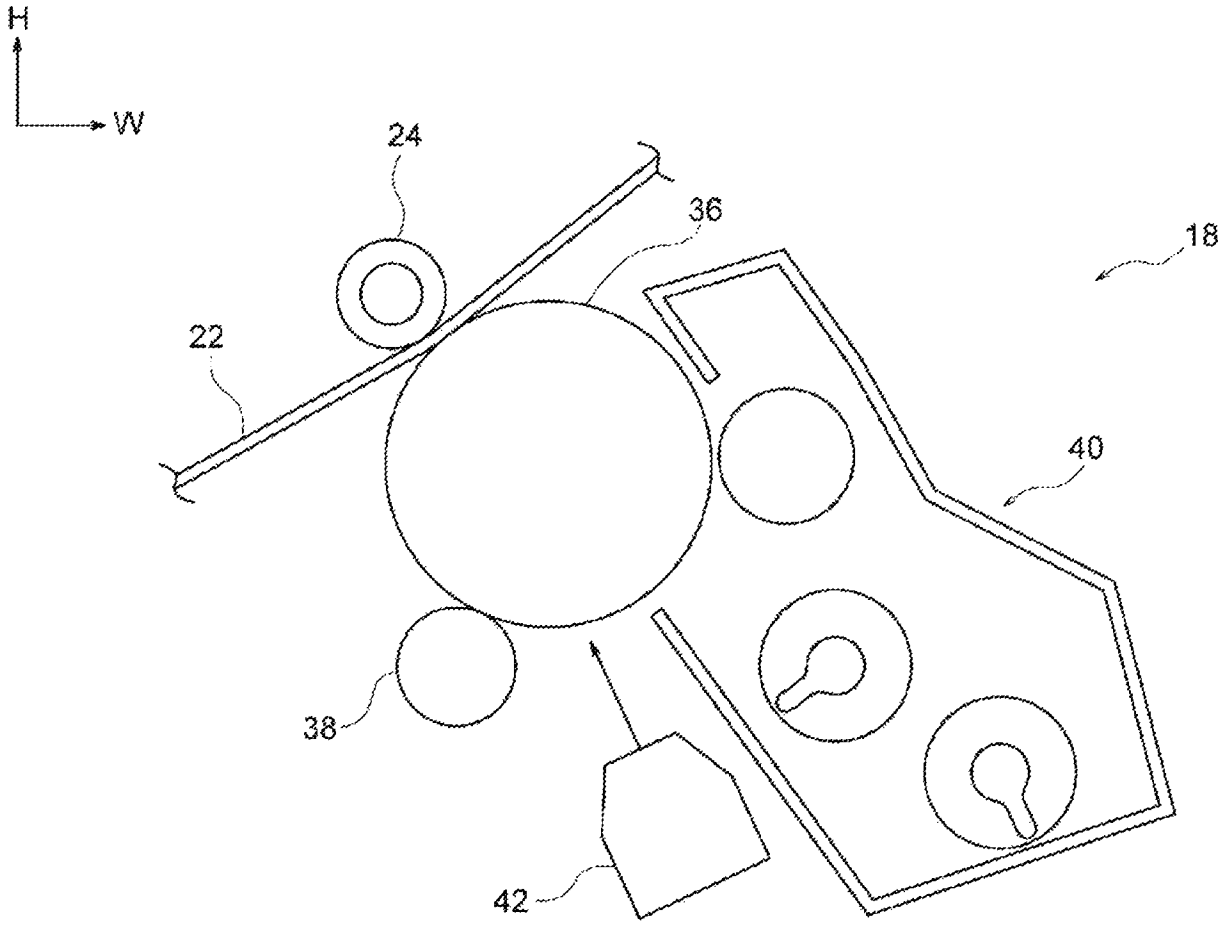
FIG. 9 illustrates an image forming unit included in an image forming apparatus according to the first exemplary embodiment of the present disclosure.

As illustrated in FIG. 9, each image forming unit 18 includes an image carrier 36 that carries an image and a charging roller 38 that charges the peripheral surface of the image carrier 36. Each image forming unit 18 also includes an exposure device 42 that irradiates the charged peripheral surface of the image carrier 36 with exposure light to form an electrostatic latent image and a developing device 40 that develops and visualizes the electrostatic latent image into a toner image.

As illustrated in FIG. 10, the image forming section 20 also includes an endless transfer belt 22 to which the toner images formed by the image forming units 18 of the respective colors are transferred and first transfer rollers 24 that transfer the toner images formed by the image forming units 18 onto the transfer belt 22. The image forming section 20 also includes a second transfer roller 46 that transfers the toner images that have been transferred to the transfer belt 22 onto the sheet member P. The image forming section 20 also includes the fixing unit 34 that fixes the toner image on the sheet member P to the sheet member P by heating and pressing the toner image. The structure of the fixing unit 34 will be described in detail below.

Operation of Image Forming Apparatus

The image forming apparatus 10 forms an image in the following manner.

First, the charging rollers 38 of the respective colors, to which a voltage is applied, come into contact with the peripheral surfaces of the image carriers 36 of the respective colors and uniformly charge the peripheral surfaces of the image carriers 36 to a predetermined negative potential. Subsequently, the exposure devices 42 of the respective colors form electrostatic latent images by irradiating the charged peripheral surfaces of the image carriers 36 of the respective colors with exposure light based on data input from the outside.

Thus, the electrostatic latent images corresponding to the image data are formed on the peripheral surfaces of the image carriers 36. The developing devices 40 of the respective colors develop and visualize the electrostatic latent images into toner images. The first transfer rollers 24 transfer the toner images formed on the peripheral surfaces of the image carriers 36 of the respective colors onto the transfer belt 22.

The feed roller 30 feeds the top sheet member P of the stack on the storage member 26 toward a transfer position T, at which the transfer belt 22 and the second transfer roller 46 are in contact with each other, along the transport path 28. The second transfer roller 46 and the transfer belt 22 transport the sheet member P while nipping the sheet member P therebetween at the transfer position T, so that the toner image on the peripheral surface of the transfer belt 22 is transferred to the sheet member P.

The fixing unit 34 fixes the toner image that has been transferred to the sheet member P to the sheet member P. The sheet member P to which the toner image is fixed is discharged to the outside of the apparatus body 10*a* by the discharge roller unit 48.

Relevant Structure

The discharge roller unit 48, the fixing unit 34, and the guide structure 60 according to the present exemplary embodiment will now be described.

Discharge Roller Unit 48

As illustrated in FIG. 1, the discharge roller unit 48 includes a first roller 52 and a second roller 54.

The first roller 52 includes a shaft 52*a* that extends in the apparatus depth direction and plural roller portions 52*b* that are cylindrical and through which the shaft 52*a* extends. The roller portions 52*b* are arranged with similar gaps therebetween, and both end portions of the shaft 52*a* are supported by support members (not shown) so that the first roller 52 is rotatable.

The second roller 54 faces the first roller 52 with the transport path 28, along which the sheet member P is transported, disposed therebetween. More specifically, the second roller 54 is disposed below the first roller 52 and faces the first roller 52 with the transport path 28, along which the sheet member P is transported, disposed therebetween. Thus, a portion of the transport path 28 along which the sheet member P is transported by the first roller 52 and the second roller 54 extends in the apparatus width direction when viewed in the apparatus depth direction.

The second roller 54 includes a shaft 54*a* that extends in the apparatus depth direction and plural roller portions 54*b* that are cylindrical and through which the shaft 54*a* extends. The roller portions 54*b* are arranged with similar gaps therebetween, and are in contact with the roller portions 52*b*. A rotational force is transmitted to the shaft 54*a* from a driving member (not shown), so that the second roller 54 is rotated in the direction of arrow F1 and the first roller 52 is rotated by the second roller 54 in the direction of arrow F2.

According to the present exemplary embodiment, the transport speed at which the discharge roller unit 48 transports the sheet member P is lower than the transport speed at which the fixing unit 34 transports the sheet member P. The transport speed at which the discharge roller unit 48 transports the sheet member P is, for example, 99% of the transport speed at which the fixing unit 34 transports the sheet member P.

Fixing Unit 34

As illustrated in FIG. 1, when viewed in the apparatus depth direction, the fixing unit 34 is disposed on one side of the discharge roller unit 48 (same side as the second transfer roller 46 in FIG. 10) in the apparatus width direction and below the discharge roller unit 48. The distance from the fixing unit 34 to the discharge roller unit 48 along the transport path 28 in the transporting direction in which the sheet member P is transported is set such that the sheet member P that is being transported by the fixing unit 34 may also be transported by the discharge roller unit 48. In other words, the sheet member P may simultaneously receive a transporting force applied by the fixing unit 34 and a transporting force applied by the discharge roller unit 48. The fixing unit 34 includes a heating roller 58 that heats the sheet member P and a pressing roller 56 that presses the sheet member P against the heating roller 58.

Pressing Roller 56

The pressing roller 56 is disposed on the same side of the transport path 28, along which the sheet member P is transported, as the side on which the second transfer roller 46 is disposed (see FIG. 10). The pressing roller 56 includes a shaft 56*a* that extends in the apparatus depth direction, a cylindrical rubber portion 56*b*, and a coating (not shown) that covers the rubber portion 56*b*.

The shaft 56*a* extends through the rubber portion 56*b*, and both end portions of the shaft 56*a* project from the rubber portion 56*b*. The end portions of the shaft 56*a* are supported by support members (not shown) so that the pressing roller 56 is rotatable, and the support members are urged by urging members so that the pressing roller 56 is urged against the heating roller 58. Accordingly, the pressing roller 56 presses the sheet member P that is transported against the heating roller 58. More specifically, the pressing roller 56 comes into contact with a non-image surface (surface on which no toner image is formed) of the sheet member P that is transported and presses the sheet member P against the heating roller 58.

Heating Roller 58

As illustrated in FIG. 1, the heating roller 58 faces the pressing roller 56 with the transport path 28, along which the sheet member P is transported, disposed therebetween. More specifically, the heating roller 58 is disposed on the other side of the pressing roller 56 (same side as the discharge roller unit 48) in the apparatus width direction and below the pressing roller 56. Thus, the line tangent to a portion of the transport path 28 along which the sheet member P is transported by the heating roller 58 and the pressing roller 56 is inclined upward in the up-down direction and toward the discharge roller unit 48 when viewed in the apparatus depth direction.

The portion of the transport path 28 between the fixing unit 34 and the discharge roller unit 48 is curved such that the side thereof facing the pressing roller 56 is convex when viewed in the apparatus depth direction.

The heating roller 58 includes a cylindrical shaft 58*a* that extends in the apparatus depth direction, a coating (not shown) that covers the shaft 58*a*, and a heating portion 58*b* disposed in the shaft 58*a*. In this configuration, the surface temperature of the heating roller 58 is, for example, 190° C.

A rotational force is transmitted to the heating roller 58 from a driving member (not shown), so that the heating roller 58 is rotated in the direction of arrow E1 and the pressing roller 56 is rotated by the heating roller 58 in the direction of arrow E2.

In the present exemplary embodiment, the transport speed at which the fixing unit 34 transports the sheet member P is, for example, 60 mm/s, and the transport speed at which the above-described discharge roller unit 48 transports the sheet member P is, for example, 59.4 mm/s.

Guide Structure 60

As illustrated in FIG. 1, the guide structure 60 is disposed between the fixing unit 34 and the discharge roller unit 48 in the transporting direction of the sheet member P. The guide structure 60 guides the sheet member P on which the toner image has been fixed by the fixing unit 34 toward the discharge roller unit 48. The guide structure 60 includes a first guide member 62, a second guide member 72, and a third guide member 82. The first guide member 62 and the second guide member 72 are disposed on the same side of the transport path 28 as the side on which the pressing roller 56 is disposed. The third guide member 82 is disposed on the same side of the transport path 28 as the side on which the heating roller 58 is disposed. In other words, the first guide member 62 and the second guide member 72 face the non-image surface of the sheet member P that is transported, and the third guide member 82 faces an image surface (surface on which the toner image is formed) of the sheet member P that is transported.

The first guide member 62 is disposed adjacent to the fixing unit 34, and the second guide member 72 is disposed adjacent to the discharge roller unit 48. In other words, the first guide member 62 and the second guide member 72 are arranged in that order in the transporting direction of the sheet member P from the upstream side toward the downstream side.

First Guide Member 62

As illustrated in FIG. 1, the first guide member 62 is spaced from the fixing unit 34 in the transporting direction of the sheet member P. The first guide member 62 is made of acrylonitrile-butadiene-styrene resin (hereinafter referred to as "ABS resin"), which is an example of a resin material, and includes a flat plate-shaped plate portion 64 and plural ribs 66 that project from the plate portion 64 toward the transport path 28. The ABS resin has a thermal conductivity of 0.25 W/mK. The plate portion 64 is an example of a plate member, and the ribs 66 are an example of a projecting portion.

When viewed in the apparatus depth direction, the plate portion 64 is inclined upward in the up-down direction and toward the discharge roller unit 48 along the transport path 28. In addition, when viewed in the thickness direction of the plate portion 64, the plate portion 64 has a rectangular shape that extends in the apparatus depth direction (width direction of the sheet member P) to cover the transported sheet member P in the apparatus depth direction (see FIG. 7).

The plate portion 64 has a front surface 64*a* that faces the transport path 28 and a back surface 64*b* that is opposite to the front surface 64*a* and that faces away from the sheet member P that is transported. The ribs 66 are formed on the front surface 64*a* of the plate portion 64.

Figure 7:
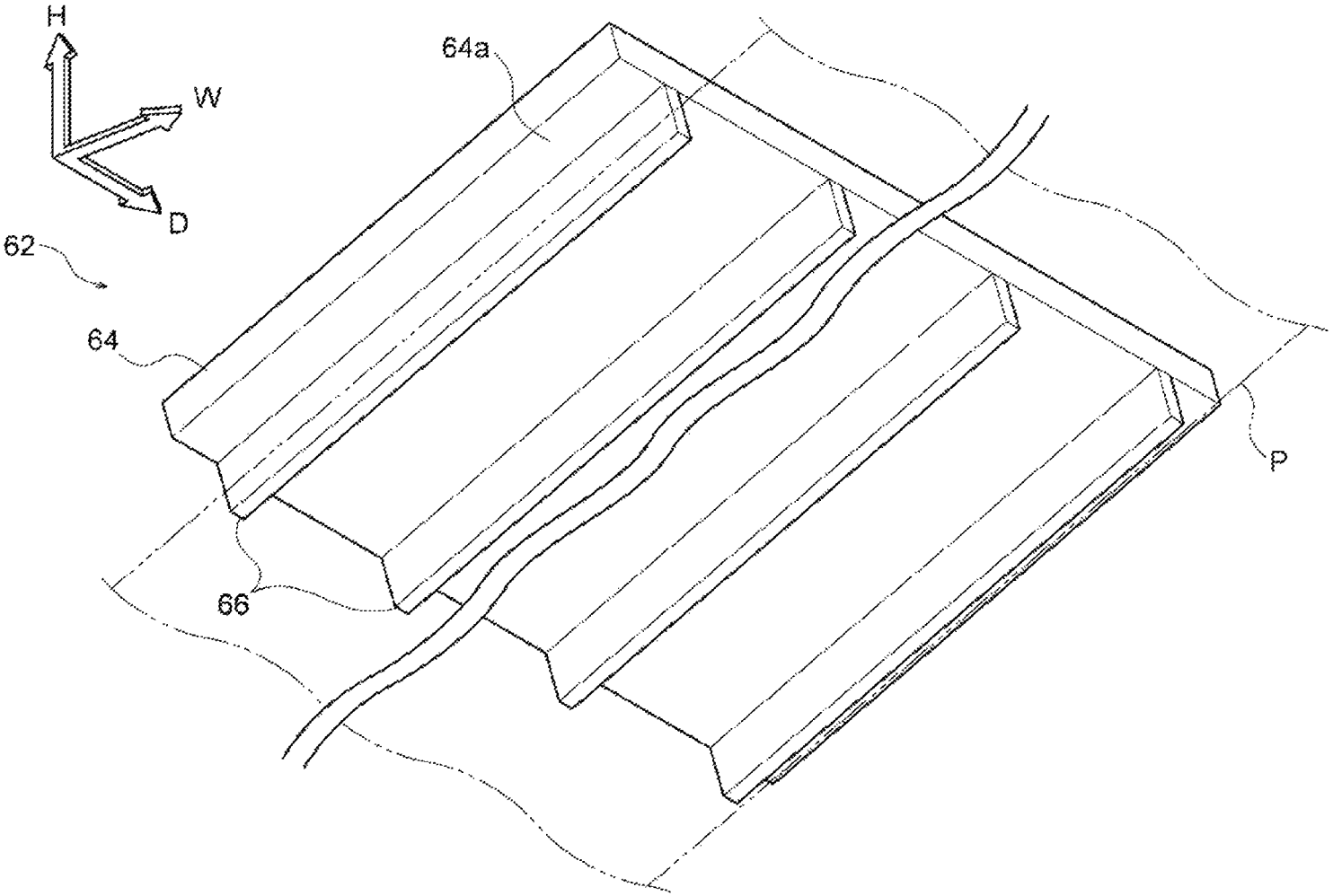
FIG. 7 is a perspective view of a first guide member included in the guide structure according to the first exemplary embodiment of the present disclosure.
Figure 8:
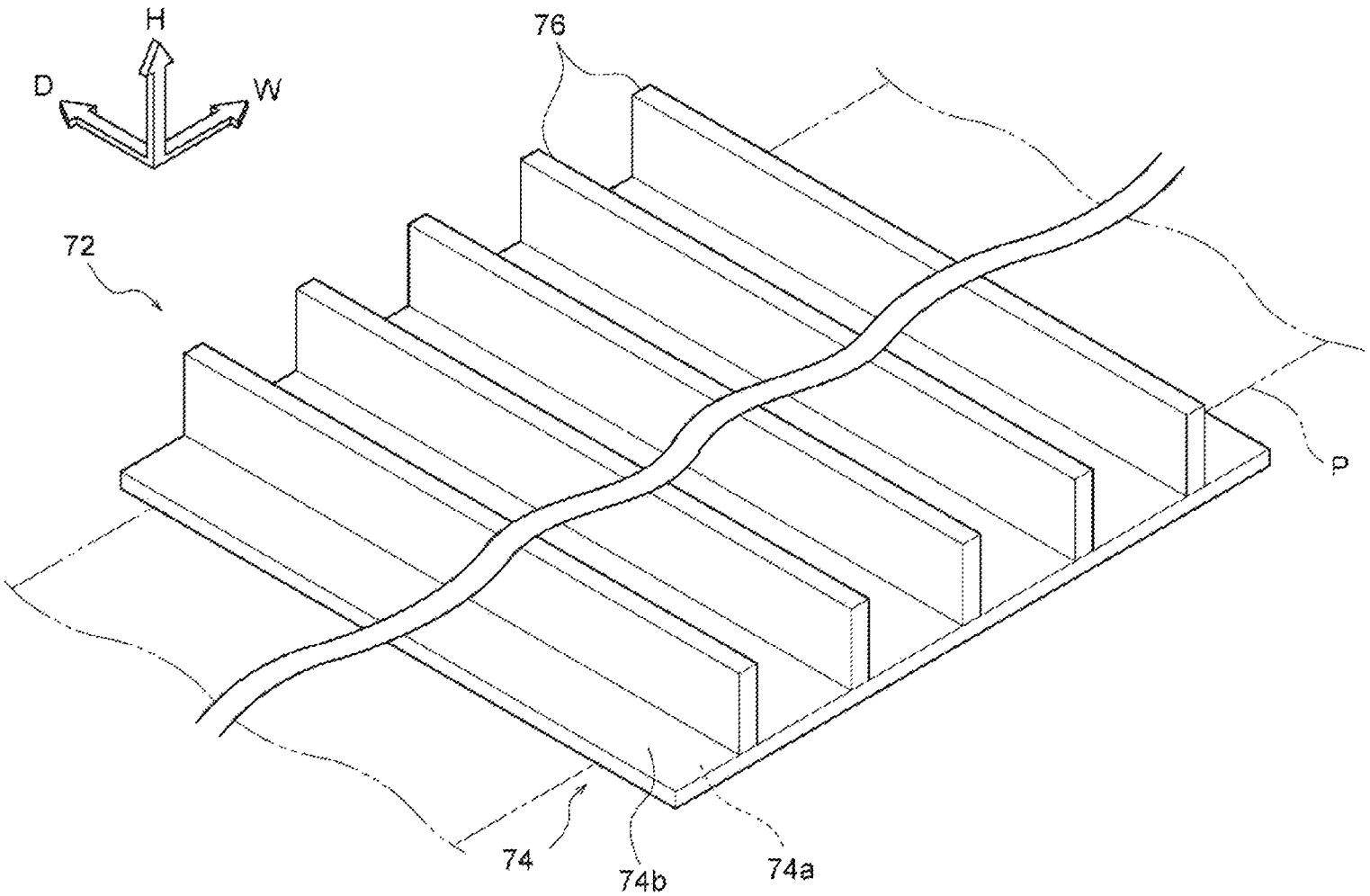
FIG. 8 is a perspective view of a second guide member included in the guide structure according to the first exemplary embodiment of the present disclosure.

The ribs 66 project from the front surface 64*a* of the plate portion 64 toward the sheet member P that is transported, and extend in the transporting direction of the sheet member P (see FIG. 7). Each rib 66 has a rectangular shape that extends in the thickness direction of the plate portion 64 in cross section taken in a direction that crosses the longitudinal direction of the rib 66. The ribs 66 are arranged in a direction (apparatus depth direction) that crosses the transporting direction of the sheet member P. The ribs 66 are provided to reduce the contact area between the first guide member 62 and the sheet member P that is transported, and at least include ribs 66 that come into contact with the end portions of the sheet member P that is transported and a rib 66 that supports a central portion of the sheet member P. The ribs 66 function as contact-area-reducing members for reducing the contact area between the first guide member 62 and the sheet member P that is transported.

Figure 2A:
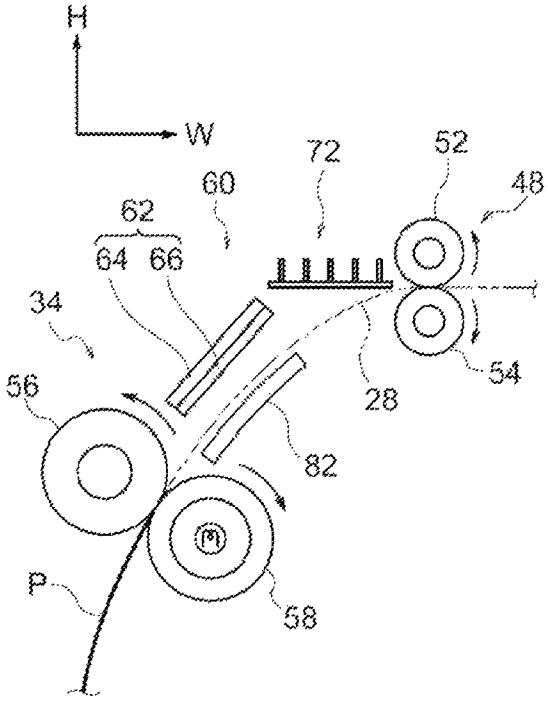
FIGS. 2A, 2B, and 2C illustrate the manner in which the guide structure according to the first exemplary embodiment of the present disclosure guides a sheet member.
Figure 2B:
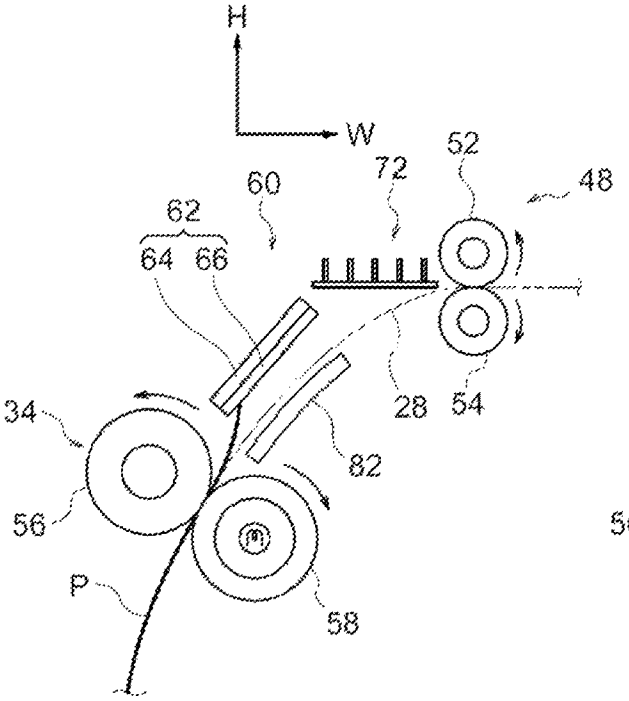
Figure 2C:
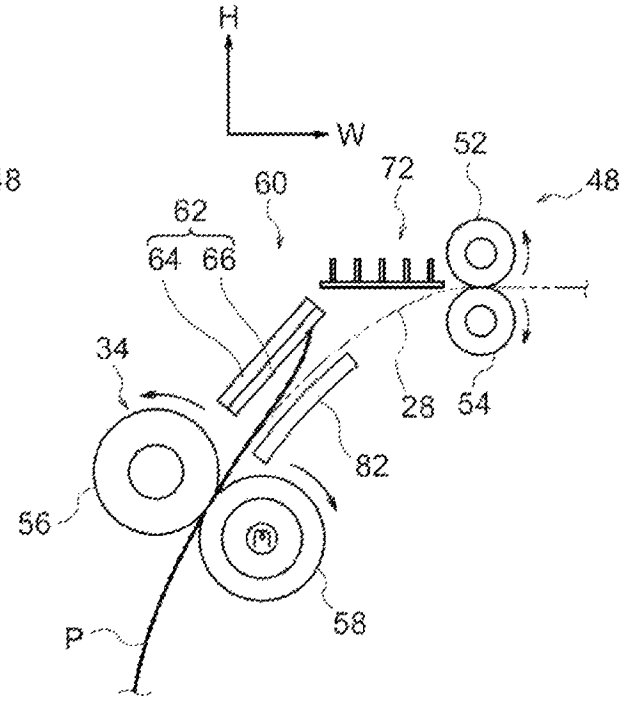

In this configuration, the leading end of the sheet member P that is transported while being nipped between the pressing roller 56 and the heating roller 58 may be curved (curled) toward the first guide member 62. In such a case, as illustrated in FIGS. 2A, 2B, and 2C, the leading end of the sheet member P comes into contact with the ends of the ribs 66 of the first guide member 62. The sheet member P moves downstream in the transporting direction while the leading end thereof is in contact with the ends of the ribs 66. Thus, the first guide member 62 guides the sheet member P toward the discharge roller unit 48.

Second Guide Member 72

As illustrated in FIG. 1, when viewed in the apparatus depth direction, the second guide member 72 is spaced from the first guide member 62 in a direction along the plate surface of the plate portion 64 of the first guide member 62. Here, the expression "spaced in a direction along the plate surface" means that the second guide member 72 does not overlap the first guide member 62 in the plate thickness direction. The second guide member 72 is composed of a stainless steel plate, which is an example of a metal material, and includes a flat plate-shaped plate portion 74 and plural heat dissipation plates 76 that project from the plate portion 74 in a direction away from the transport path 28. The stainless steel has a thermal conductivity of 18 W/mK, which is higher than that of the ABS resin.

Accordingly, heat more easily transfers in the second guide member 72 than in the first guide member 62. More specifically, the second guide member 72 more easily receives heat from the outside and dissipates heat to the outside than does the first guide member 62. In other words, the material of the second guide member 72 has higher thermal emissivity and absorptivity than those of the material of the first guide member 62. The heat dissipation plates 76 are an example of a heat dissipating unit.

The plate portion 74 extends in the apparatus width direction when viewed in the apparatus depth direction. When viewed in the thickness direction of the plate portion 74, the plate portion 74 has a rectangular shape that extends in the apparatus depth direction (width direction of the sheet member P) to cover the transported sheet member P in the apparatus depth direction (see FIG. 8).

The plate portion 74 includes a contact surface 74*a* that faces the transport path 28 and comes into contact with the sheet member P that is transported and a non-contact surface 74*b* that is opposite to the contact surface 74*a* and that does not come into contact with the sheet member P that is transported. The position of the contact surface 74*a* in the up-down direction is similar to the position of the contact portion between the first roller 52 and the second roller 54 of the discharge roller unit 48 in the up-down direction. The heat dissipation plates 76 are formed on the non-contact surface 74*b* (see FIG. 8).

The heat dissipation plates 76 have plate surfaces that face in the transporting direction of the sheet member P. The heat dissipation plates 76 extend in the width direction of the sheet member P that is transported (apparatus depth direction). The heat dissipation plates 76 are arranged in the transporting direction of the sheet member P (see FIG. 8). To dissipate heat from the second guide member 72 and to increase the flexural rigidity of the second guide member 72 when viewed in the transporting direction of the sheet member P, the heat dissipation plates 76 may extend in the width direction of the sheet member P within a limited range. More specifically, when the length of the plate portion 74 in the width direction of the sheet member P is 100, the length of the heat dissipation plates 76 may be greater than or equal to 70, and is preferably greater than or equal to 80. Thus, the heat dissipation plates 76 also function as reinforcing members for increasing the flexural rigidity of the second guide member 72.

Figure 3A:
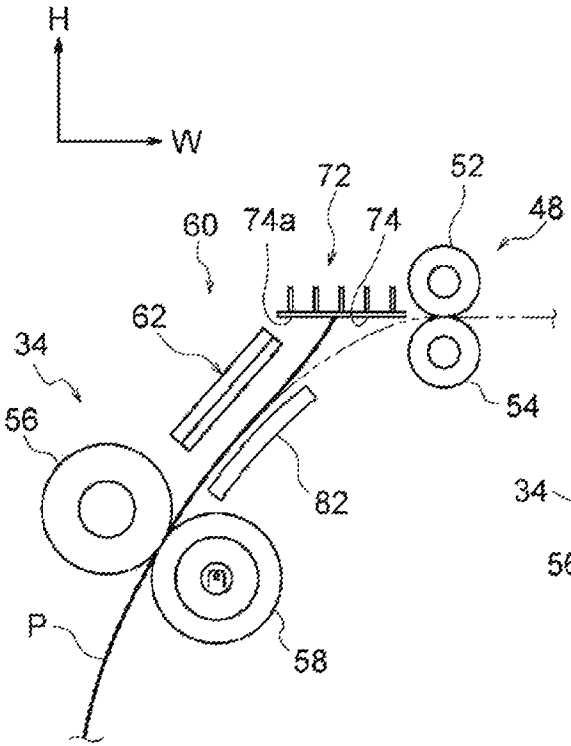
FIGS. 3A, 3B, and 3C illustrate the manner in which the guide structure according to the first exemplary embodiment of the present disclosure guides a sheet member.
Figure 3B:
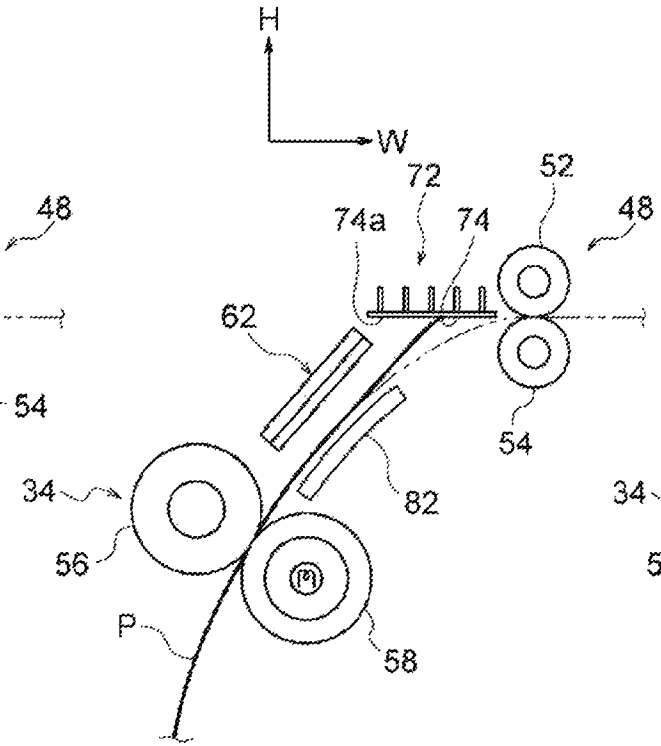
Figure 3C:
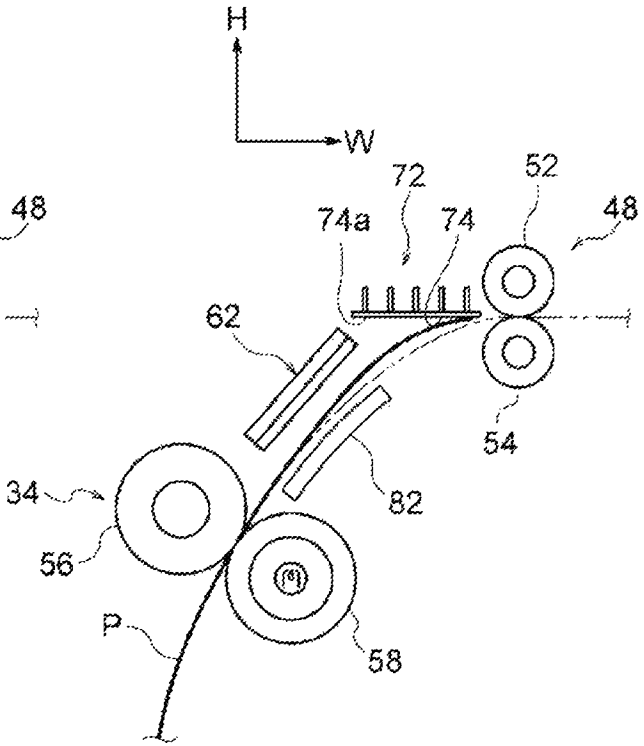

In this configuration, the leading end of the sheet member P guided toward the discharge roller unit 48 by the first guide member 62 comes into contact with the contact surface 74*a* of the plate portion 74 of the second guide member 72, as illustrated in FIGS. 3A, 3B, and 3C. The sheet member P moves downstream in the transporting direction of the sheet member P while the leading end thereof is in contact with the contact surface 74*a*. Thus, the second guide member 72 guides the sheet member P toward the discharge roller unit 48.

The second guide member 72 receives heat from the sheet member P, and the heat dissipation plates 76 dissipate heat from the second guide member 72.

The sheet member P that is transported while being nipped between the pressing roller 56 and the heating roller 58 may have a leading end that is not curled. In such a case, according to the present exemplary embodiment, when viewed in the apparatus depth direction, the angle (θ1 in FIG. 1) between the contact surface 74*a* of the second guide member 72 and the sheet member P in such a state that the leading end thereof is in contact with the contact surface 74*a* is less than or equal to 60 degrees. To enable the sheet member P to move along the contact surface 74*a*, the angle θ1 may be less than or equal to 55 degrees, and is preferably less than or equal to 50 degrees.

Third Guide Member 82

As illustrated in FIG. 1, when viewed in the apparatus depth direction, the third guide member 82 faces the first guide member 62 and the second guide member 72 with the transport path 28 disposed therebetween. The third guide member 82 is made of ABS resin, which is an example of a resin material, and is curved along the transport path 28 when viewed in the apparatus depth direction. The third guide member 82 has a curved surface 82*a* that faces the transport path 28.

Figure 4A:
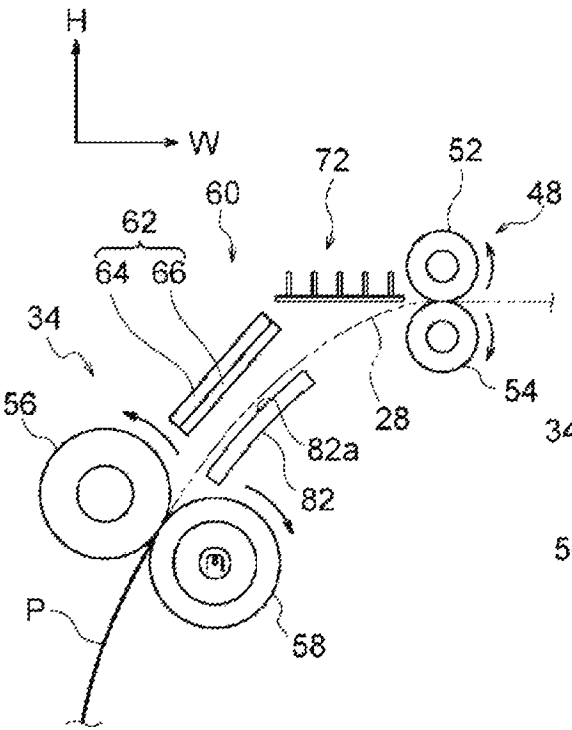
FIGS. 4A, 4B, and 4C illustrate the manner in which the guide structure according to the first exemplary embodiment of the present disclosure guides a sheet member.
Figure 4B:
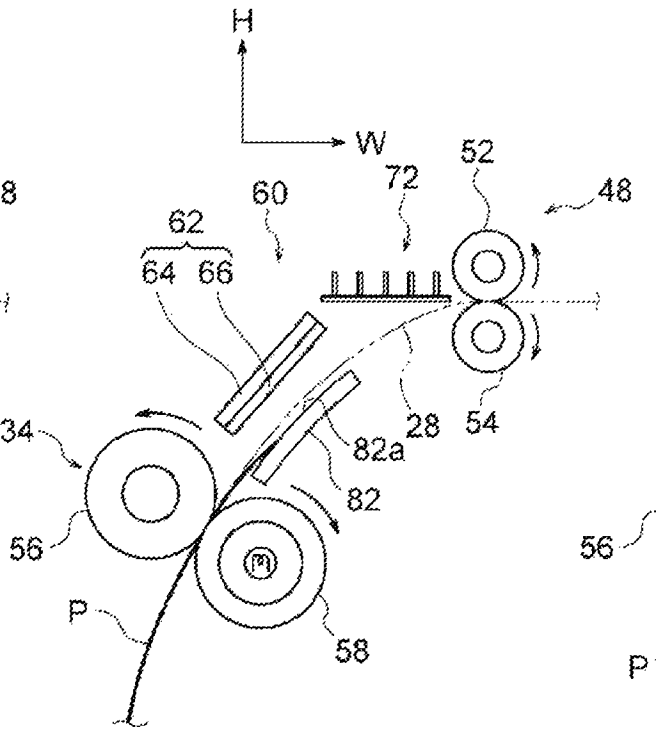
Figure 4C:
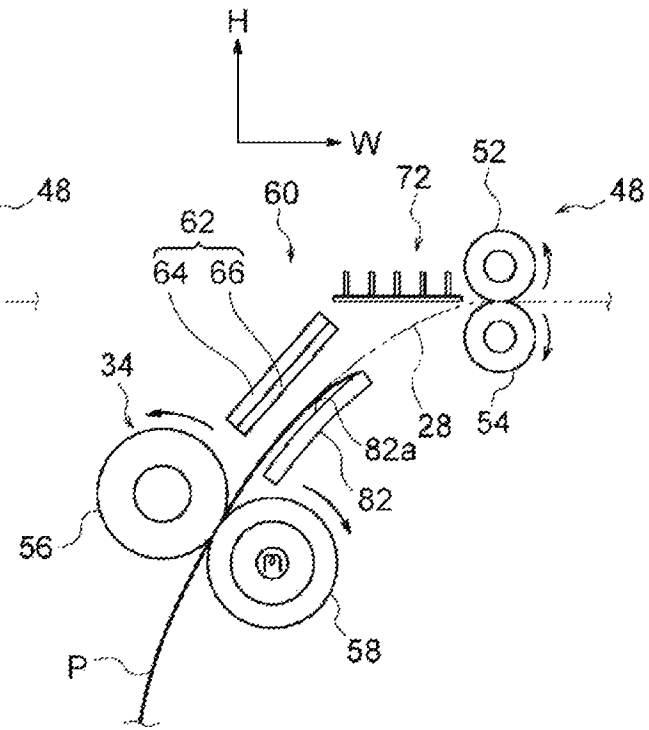

In this configuration, the leading end of the sheet member P that is transported while being nipped between the pressing roller 56 and the heating roller 58 may be curved (curled) toward the third guide member 82. In such a case, as illustrated in FIGS. 4A, 4B, and 4C, the leading end of the sheet member P comes into contact with the curved surface 82*a* of the third guide member 82. Then, the sheet member P moves downstream in the transporting direction while the leading end thereof is in contact with the curved surface 82*a*. Thus, the third guide member 82 guides the sheet member P toward the discharge roller unit 48.

Figure 5A:
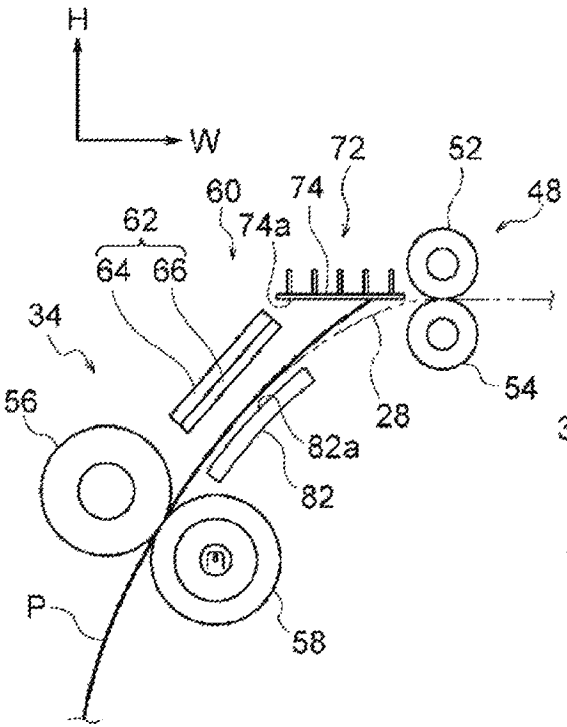
FIGS. 5A, 5B, and 5C illustrate the manner in which the guide structure according to the first exemplary embodiment of the present disclosure guides a sheet member.
Figure 5B:
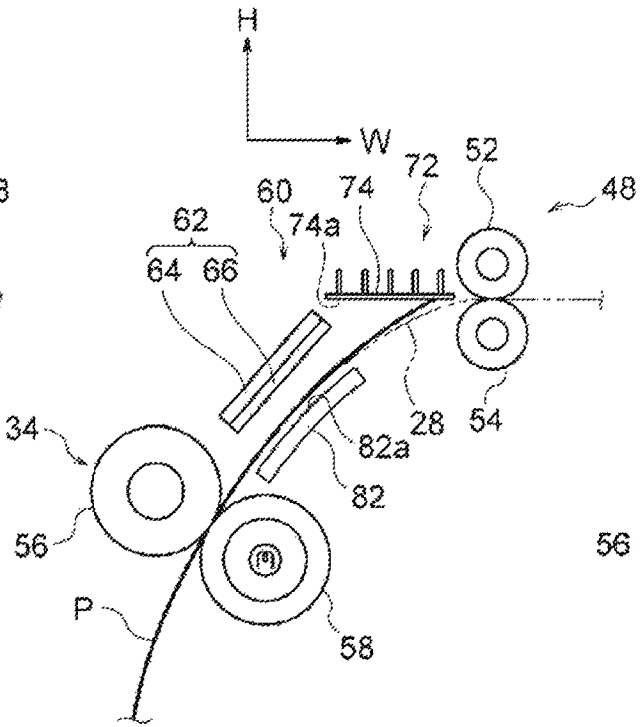
Figure 5C:
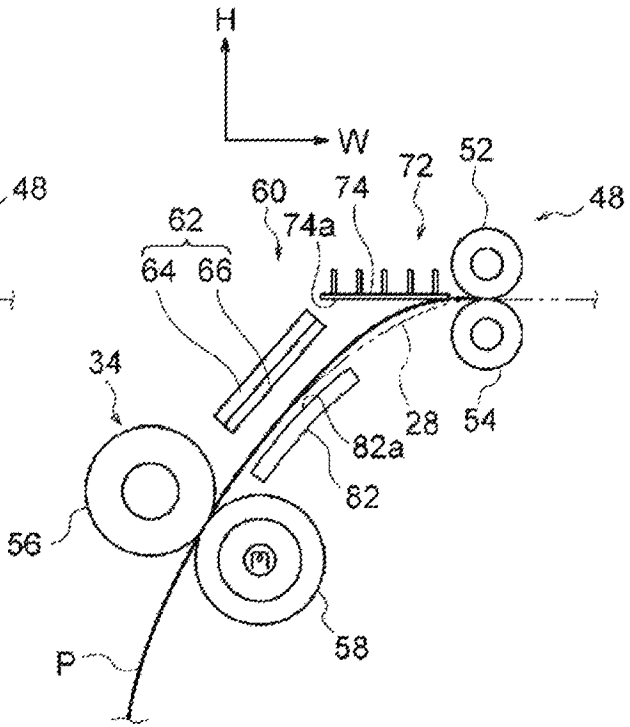

The leading end of the sheet member P guided toward the discharge roller unit 48 by the third guide member 82 comes into contact with the contact surface 74*a* of the plate portion 74 of the second guide member 72, as illustrated in FIGS. 5A, 5B, and 5C. The sheet member P moves downstream in the transporting direction of the sheet member P while the leading end thereof is in contact with the contact surface 74*a*. Thus, the second guide member 72 guides the sheet member P toward the discharge roller unit 48.

Operation of Relevant Structure

The operation of the relevant structure according to the present exemplary embodiment will now be described.

After the toner image is transferred to the image surface of the sheet member P, the sheet member P is transported to the fixing unit 34, as illustrated in FIGS. 2A and 4A. Then, the heating roller 58 and the pressing roller 56 of the fixing unit 34 rotate and nip the leading end of the sheet member P. The pressing roller 56 presses the sheet member P against the heating roller 58, and the heating roller 58 heats the sheet member P. Thus, the heating roller 58 heats the sheet member P pressed thereagainst by the pressing roller 56 to, for example, about 100° C., so that the toner image is fixed to the sheet member P.

The leading end of the sheet member P that is transported while being nipped between the pressing roller 56 and the heating roller 58 may be curved (curled) toward the first guide member 62. In such a case, as illustrated in FIGS. 2B, and 2C, the leading end of the sheet member P comes into contact with the ends of the ribs 66 of the first guide member 62. The sheet member P moves downstream in the transporting direction while the leading end thereof is in contact with the ends of the ribs 66. Thus, the first guide member 62 guides the sheet member P toward the discharge roller unit 48.

The leading end of the sheet member P that is transported while being nipped between the pressing roller 56 and the heating roller 58 may instead be curved (curled) toward the third guide member 82. In such a case, as illustrated in FIGS. 4B and 4C, the leading end of the sheet member P comes into contact with the curved surface 82*a* of the third guide member 82. Then, the sheet member P moves downstream in the transporting direction while the leading end thereof is in contact with the curved surface 82*a*. Thus, the third guide member 82 guides the sheet member P toward the discharge roller unit 48.

The sheet member P that has been guided toward the discharge roller unit 48 by the first guide member 62 or the third guide member 82, or that has been guided toward the discharge roller unit 48 without coming into contact with the first guide member 62 or the third guide member 82, moves further downstream.

As illustrated in FIGS. 3A and 5A, the leading end of the sheet member P comes into contact with the contact surface 74*a* of the plate portion 74 of the second guide member 72. Then, the sheet member P moves further downstream in the transporting direction of the sheet member P while the leading end thereof is in contact with the contact surface 74*a*. Thus, the second guide member 72 guides the sheet member P toward the discharge roller unit 48. As illustrated in FIGS. 3B, 3C, 5B, and 5C, the sheet member P is guided by the second guide member 72 while the non-image surface thereof on which no toner image is formed is in contact with the second guide member 72. Then, the leading end of the sheet member P is nipped between the first roller 52 and the second roller 54 of the discharge roller unit 48, and the discharge roller unit 48 starts to transport the sheet member P. More specifically, the discharge roller unit 48 starts to transport the sheet member P while sheet member P is transported by the fixing unit 34.

Figure 6A:
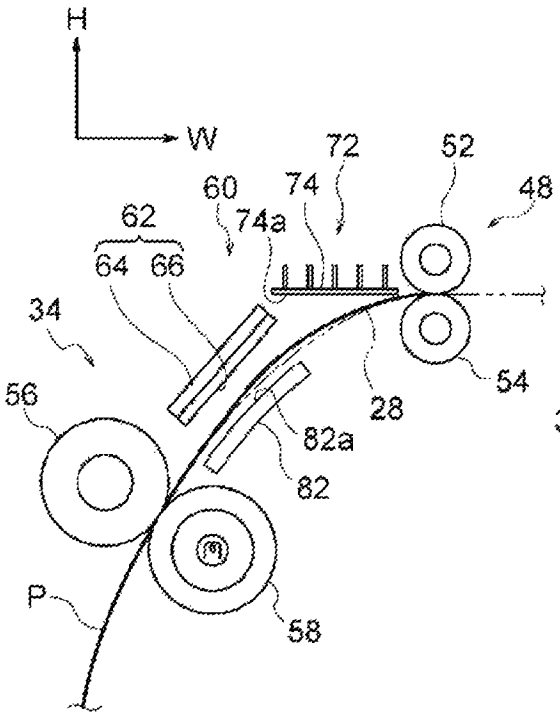
FIGS. 6A, 6B, and 6C illustrate the manner in which the guide structure according to the first exemplary embodiment of the present disclosure guides a sheet member.
Figure 6B:
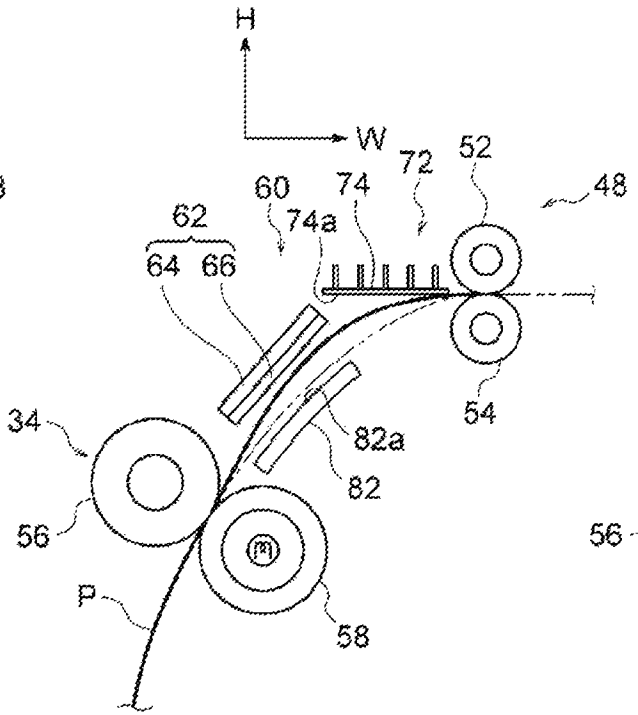
Figure 6C:
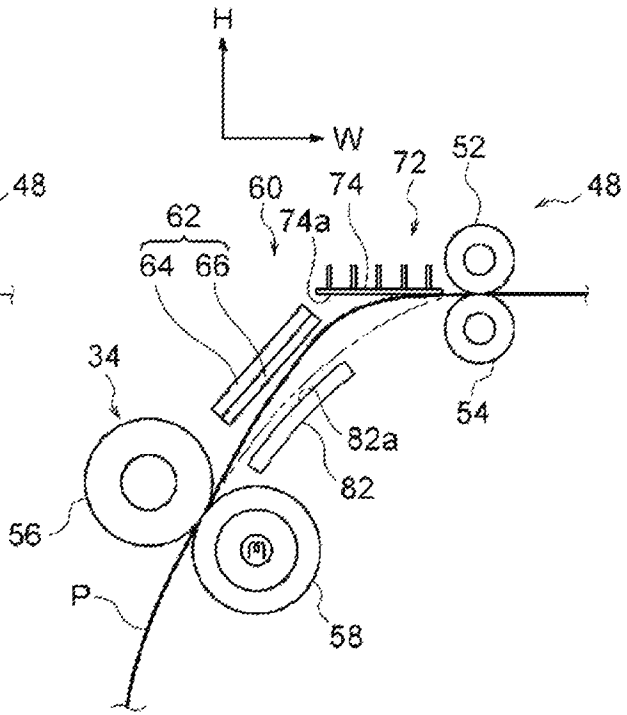

As described above, the transport speed at which the discharge roller unit 48 transports the sheet member P is lower than the transport speed at which the fixing unit 34 transports the sheet member P. Therefore, as illustrated in FIGS. 6A, 6B, and 6C, the sheet member P is transported while a portion thereof between the fixing unit 34 and the discharge roller unit 48 is bent toward the second guide member 72.

Since the sheet member P is bent toward the second guide member 72, the contact area between the sheet member P and the second guide member 72 is greater than that in the case where the transport speed at which the discharge roller unit 48 transports the sheet member P is similar to the transport speed at which the fixing unit 34 transports the sheet member P.

The second guide member 72 receives heat of the sheet member P from a portion of the sheet member P that is in contact with the second guide member 72, and the heat dissipation plates 76 of the second guide member 72 dissipate heat from the second guide member 72. The discharge roller unit 48 discharges the sheet member P to the outside of the apparatus body 10*a* by transporting the sheet member P while the sheet member P is continuously in contact with the second guide member 72.

Summary

As described above, the guide structure 60 is configured such that the thermal conductivity of the material of the second guide member 72 adjacent to the discharge roller unit 48 is higher than that of the material of the first guide member 62 adjacent to the fixing unit 34. In other words, the thermal conductivity of the material of the first guide member 62 adjacent to the fixing unit 34 is lower than that of the material of the second guide member 72 adjacent to the discharge roller unit 48.

Therefore, the amount of heat generated by the fixing unit 34 and transferred to the second guide member 72 through the first guide member 62 is less than that in the case where the thermal conductivity of the material of the first guide member 62 adjacent to the fixing unit 34 is similar to that of the material of the second guide member 72. Also, the amount of heat which the second guide member 72 receives from the sheet member P is greater than that in the case where the thermal conductivity of the material of the second guide member 72 adjacent to the discharge roller unit 48 is similar to that of the material of the first guide member 62.

Thus, according to the guide structure 60, the temperature of the sheet member P transported toward the discharge roller unit 48 is lower than that in the case where the thermal conductivity of the material of the first guide member 62 is similar to that of the material of the second guide member 72. When the temperature of the sheet member P is reduced, the toner image formed on the sheet member P are solidified, so that contact marks (so-called "roller marks") due to contact with the discharge roller unit 48 are not easily formed on the toner image on the sheet member P.

To summarize, the occurrence of contact marks on the toner image formed on the sheet member P due to contact with the discharge roller unit 48 is less than that in the case where guide members that guide the sheet member P from the fixing unit 34 to the discharge roller unit 48 are made of materials having similar thermal conductivities over the entirety thereof.

In addition, the guide structure 60 is configured such that the first guide member 62 is made of a resin material and the second guide member 72 is made of a metal material. Therefore, the amount of heat generated by the fixing unit 34 and transferred to the second guide member 72 through the first guide member 62 is less than that in the case where the first guide member 62 and the second guide member 72 are both made of a metal material. Also, the amount of heat which the second guide member 72 receives from the sheet member P is greater than that in the case where the first guide member 62 and the second guide member 72 are both made of a resin material.

To summarize, the temperature of the sheet member P is lower than that in the case where the first guide member 62 and the second guide member 72 are both made of a metal material or that in the case where the first guide member 62 and the second guide member 72 are both made of a resin material. Accordingly, the occurrence of contact marks on the toner image formed on the sheet member P due to contact with the discharge roller unit 48 is reduced.

In addition, the guide structure 60 is configured such that the heat dissipation plates 76 dissipate heat from the second guide member 72. Therefore, the temperature of the sheet member P that is in contact with the second guide member 72 is lower than that in the case where the heat of the second guide member 72 is accumulated in the second guide member 72 (in the case where the second guide member 72 includes only the plate portion). Accordingly, the occurrence of contact marks on the toner image formed on the sheet member P due to contact with the discharge roller unit 48 is reduced.

In addition, the guide structure 60 is configured such that the plate surfaces of the heat dissipation plates 76 face in the transporting direction of the sheet member P and that the heat dissipation plates 76 extend in the width direction of the sheet member P that is transported (apparatus depth direction). Therefore, the amount by which the plate portion 74 of the second guide member 72 is bent when viewed in the transporting direction of the sheet member P is less than that in the case where the plate surfaces of the heat dissipation plates face in the width direction of the sheet member P.

In addition, the guide structure 60 is configured such that the first guide member 62 and the second guide member 72 are spaced from each other. Therefore, the amount of heat transferred to the second guide member 72 through the first guide member 62 is less than that in the case where the first guide member 62 and the second guide member 72 are in contact with each other. Accordingly, the occurrence of contact marks on the toner image formed on the sheet member P due to contact with the discharge roller unit 48 is reduced.

In addition, the guide structure 60 is configured such that the first guide member 62 and the second guide member 72 are spaced from each other in a direction along the plate surface of the plate portion 64 of the first guide member 62 when viewed in the apparatus depth direction. Therefore, the amount of heat transferred to the second guide member 72 through the first guide member 62 is less than that in the case where the first guide member and the second guide member overlap in the thickness direction of the plate portion of the first guide member. Accordingly, the occurrence of contact marks on the toner image formed on the sheet member P due to contact with the discharge roller unit 48 is reduced.

In addition, the guide structure 60 is configured such that the ribs 66 are formed on the front surface 64*a* of the plate portion 64 of the first guide member 62. Therefore, the contact area between the sheet member P and the first guide member 62 is less than that in the case where the first guide member includes only the plate portion. Thus, the amount of heat which the sheet member P receives from the first guide member 62 is reduced. Accordingly, an increase in the temperature of the sheet member P is suppressed, so that the occurrence of contact marks on the toner image formed on the sheet member P due to contact with the discharge roller unit 48 is reduced.

In addition, the guide structure 60 is configured such that the ribs 66 extend in the transporting direction of the sheet member P. Therefore, unlike the case in which the ribs extend in the width direction of the sheet member P that is transported, the movement of the sheet member P is not hindered.

According to the image forming apparatus 10, the occurrence of contact marks on the toner image formed on the sheet member P due to contact with the discharge roller unit 48 is less than that in the case where the materials of all of the guide members have similar thermal conductivities. Accordingly, reduction in quality of the output image is suppressed.

In addition, according to the image forming apparatus 10, the transport speed at which the discharge roller unit 48 transports the sheet member P is lower than the transport speed at which the fixing unit 34 transports the sheet member P. Accordingly, the sheet member P is transported while being bent toward the second guide member 72, so that the contact area between the sheet member P and the second guide member 72 is increased. As a result, the temperature of the sheet member P is reduced. Accordingly, the occurrence of contact marks on the toner image formed on the sheet member P due to contact with the discharge roller unit 48 is reduced, and reduction in quality of the output image is suppressed.

In addition, according to the image forming apparatus 10, the portion of the transport path 28 between the fixing unit 34 and the discharge roller unit 48 is curved such that the side thereof facing the pressing roller 56 is convex when viewed in the apparatus depth direction. The second guide member 72 is disposed on the convex side.

Accordingly, the sheet member P that is transported more easily comes into contact with the second guide member 72 than in the case where the second guide member is disposed on the concave side.

Second Exemplary Embodiment

An example of a guide structure and an image forming apparatus according to a second exemplary embodiment of the present disclosure will now be described with reference to FIGS. 11 and 12. Differences between the first and second exemplary embodiments will be basically described.

Structure

Figure 11:
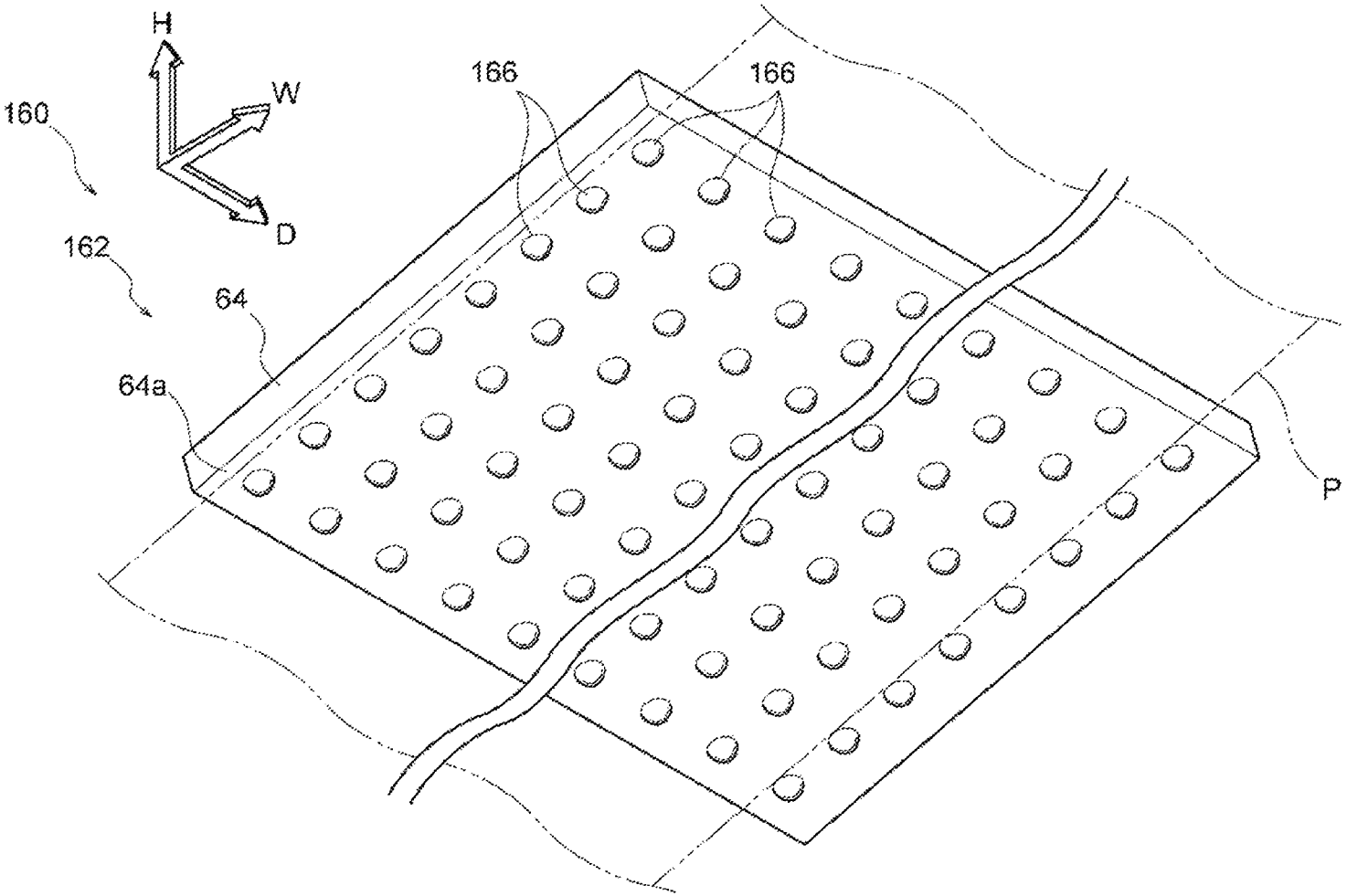
FIG. 11 is a perspective view of a first guide member included in a guide structure according to a second exemplary embodiment of the present disclosure.

Referring to FIG. 11, a guide structure 160 according to the second exemplary embodiment includes a first guide member 162. The first guide member 162 is made of ABS resin, and includes a flat plate-shaped plate portion 64 and plural projections 166 that project toward the transport path 28 (see FIG. 1) from a front surface 64*a* of the plate portion 64.

The projections 166 are hemispherical, and plural projections 166 are provided in the transporting direction of the sheet member P and in the width direction of the sheet member P. In the present exemplary embodiment, the projections 166 are arranged in the transporting direction of the sheet member P and in the width direction of the sheet member P.

Figure 12:
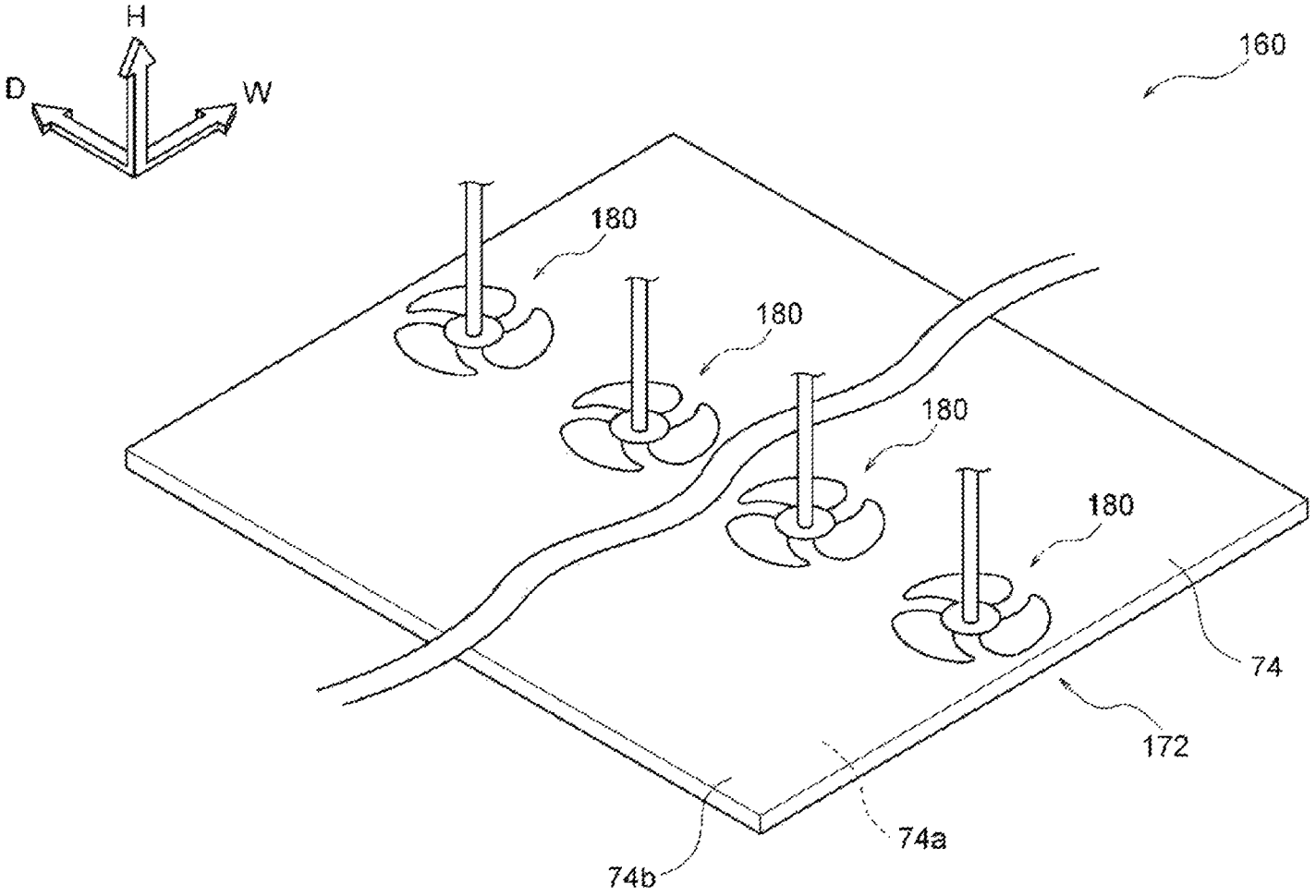
FIG. 12 is a perspective view of fans and a second guide member included in the guide structure according to the second exemplary embodiment of the present disclosure.

Referring to FIG. 12, the guide structure 160 also includes a second guide member 172. The second guide member 172 is formed of a stainless steel plate, and includes a flat plate-shaped plate portion 74. The guide structure 160 also includes plural fans 180 that are arranged in the apparatus depth direction above the second guide member 172. The fans 180 blow air toward a non-contact surface 74*b* of the plate portion 74. The fans 180 are an example of a blowing member.

Summary

As described above, the projections 166 are formed on the front surface 64*a* of the plate portion 64 of the first guide member 162. Therefore, the amount by which the first guide member is bent is less than that in the case where the contact area between the sheet member P and the first guide member is reduced by forming plural recesses in the front surface.

In addition, the guide structure 160 includes the fans 180 that blow air toward the non-contact surface 74*b* of the plate portion 74 of the second guide member 172. Therefore, unlike the case in which the surface area of the second guide member is increased to dissipate heat from the second guide member, heat is actively dissipated from the second guide member.

Although specific exemplary embodiments of the present disclosure are described in detail above, the present disclosure is not limited to the above-described exemplary embodiments. It is obvious to those skilled in the art that various other exemplary embodiments are possible within the scope of the present disclosure. For example, although not described in the above exemplary embodiments, the length of the second guide member 72, 172 may be longer than that of the first guide member 62, 162 when viewed in the width direction of the sheet member P that is transported. In this case, the contact area between the sheet member P and the second guide member 72, 172 is greater than that in the case where the length of the second guide member is shorter than that of the first guide member. Therefore, the temperature of the sheet member P is effectively reduced. Accordingly, the occurrence of contact marks on the toner image formed on the sheet member P due to contact with the discharge roller unit 48 is reduced. In this case, the above-described length is the length of a portion that directly faces the transport path 28. When one of the guide members overlaps the other, the length of the overlapping portion that does not directly face the transport path 28 is not included.

In addition, in the above-described exemplary embodiments, the discharge roller unit 48 is the roller unit disposed downstream of the fixing unit 34 in the transporting direction of the sheet member P. However, the roller unit may instead be any other roller unit that transports the sheet member P.

In the above-described exemplary embodiments, the second guide member 72, 172 comes into contact with the non-image surface of the sheet member P on which no toner image is formed. However, the second guide member may instead come into contact with the image surface of the sheet member P on which the toner image is formed. In this case, however, the effect of suppressing a reduction in quality of the toner image by bringing the second guide member 72, 172 into contact with the non-image surface of the sheet member P cannot be obtained.

In addition, in the above-described exemplary embodiments, the first guide member 62, 162 is made of a resin material and the second guide member 72, 172 is made of a metal material so that the thermal conductivity of the material of the first guide member 62, 162 differs from that of the material of the second guide member 72, 172. However, the first guide member and the second guide member may be made of different resin materials so that the thermal conductivities thereof differ from each other. In this case, however, the effect obtained when the second guide member 72, 172 is made of a metal material cannot be obtained.

Although not described in the above exemplary embodiments, heat may be dissipated from the second guide member by using both the heat dissipation plates and the fans.

In addition, although the guide structures according to the above-described exemplary embodiments of the present disclosure are, for example, each disposed downstream of a fixing device of an image forming apparatus that employs an electrophotographic system, the guide structures are not limited to this. For example, a conductive sheet, such as a metal sheet, may be used as a sheet member P, and the guide structures according to the above-described exemplary embodiments may each be disposed downstream of a fixing device in an electrostatic powder coating apparatus that forms a solid image on a surface of the conductive sheet by coating the surface.

More specifically, the developing device 40 according to the above-described exemplary embodiments may be used as a powder coating head for an electrostatic powder coating process. The conductive sheet is transported through a region close to the powder coating head. A bias voltage is applied between the powder coating head and the conductive sheet so that charged coating powder is applied to (recorded on) the sheet-shaped medium. After that, the sheet-shaped medium is heated by the fixing device so that the surface of the sheet member P is coated. The coating powder may be, for example, thermoplastic toner or thermosetting toner. The fixing device may include a roller that applies heat and pressure, or a non-contact heater that heats the sheet member P without coming into direct contact with the sheet member P.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet-member guide structure comprising:

a first guide member that guides a sheet member from a fixing unit to a transport roller unit, the fixing unit fixing an image formed on the sheet member to the sheet member by heating the sheet member that is transported, the transport roller unit transporting the sheet member; and a second guide member that comes into contact with the sheet member to which the image has been fixed by the fixing unit and guides the sheet member to the transport roller unit, the second guide member being disposed downstream of the first guide member in a transporting direction in which the sheet member is transported and being made of a material having a thermal conductivity higher than a thermal conductivity of a material of the first guide member, wherein the second guide member is only disposed on a single side of a sheet transport path where the sheet member is transported.

2. The sheet-member guide structure according to claim 1, wherein the first guide member is made of a resin material, and the second guide member is made of a metal material.

3. The sheet-member guide structure according to claim 1, wherein the sheet-member guide structure includes a heat dissipating unit that dissipates heat from the second guide member.

4. The sheet-member guide structure according to claim 3, wherein the second guide member includes a plate portion extending in a width direction of the sheet member and having a contact surface and a non-contact surface that is opposite to the contact surface, the contact surface coming into contact with the sheet member that is transported, the non-contact surface not coming into contact with the sheet member that is transported, and a heat dissipation plate that serves as the heat dissipating unit, the heat dissipation plate being attached to the non-contact surface of the plate portion and having a plate surface that faces in the transporting direction of the sheet member and extends in the width direction of the sheet member that is transported.

5. The sheet-member guide structure according to claim 3, wherein the second guide member includes a plate-shaped plate portion having a contact surface and a non-contact surface that is opposite to the contact surface, the contact surface coming into contact with the sheet member that is transported, the non-contact surface not coming into contact with the sheet member that is transported, and wherein the heat dissipating unit includes a blowing member that blows air toward the non-contact surface of the plate portion.

6. The sheet-member guide structure according to claim 1, wherein the first guide member and the second guide member are spaced from each other.

7. The sheet-member guide structure according to claim 6, wherein the first guide member is plate-shaped, and wherein the first guide member and the second guide member are apart from each other in a direction along a plate surface of the first guide member when viewed in a width direction of the sheet member that is transported.

8. The sheet-member guide structure according to claim 1, wherein the first guide member includes a plate-shaped plate member having a front surface and a back surface that is opposite to the front surface, the front surface facing the sheet member that is transported, the back surface facing away from the sheet member that is transported, and a projecting portion that projects from the front surface of the plate member.

9. The sheet-member guide structure according to claim 8, wherein the projecting portion includes a plurality of ribs that project from the front surface and extend in the transporting direction of the sheet member.

10. The sheet-member guide structure according to claim 8, wherein the projecting portion includes a plurality of projections that project from the front surface and that are arranged in the transporting direction of the sheet member and a width direction of the sheet member.

11. The sheet-member guide structure according to claim 1, wherein a length of the second guide member is longer than a length of the first guide member when viewed in a width direction of the sheet member that is transported.

12. The sheet-member guide structure according to claim 1, wherein the sheet member is a sheet of paper on which the image is formed.

13. An image forming apparatus comprising:

a fixing unit that fixes an image to a sheet member by heating the sheet member while transporting the sheet member;

a transport roller unit that transports the sheet member; and the sheet-member guide structure according to claim 1 that guides the sheet member to which the image has been fixed by the fixing unit to the transport roller unit.

14. The image forming apparatus according to claim 13, wherein the transport roller unit is arranged to transport the sheet member while the sheet member is transported by the fixing unit, and wherein a speed at which the transport roller unit transports the sheet member is lower than a speed at which the fixing unit transports the sheet member, so that the sheet member that is being transported is bent toward the second guide member.

* * * * *